US012429307B2

(12) United States Patent
Rudolph et al.

(10) Patent No.: US 12,429,307 B2
(45) Date of Patent: Sep. 30, 2025

(54) ZEROING TARGET FOR A FIREARM SIGHTING SYSTEM

(71) Applicant: The United States of America, as Represented by the Secretary of the Navy, Crane, IN (US)

(72) Inventors: Brandon William Rudolph, Bloomington, IN (US); Matthew Thompson, Bloomington, IN (US); Daniel S Spoor, Bloomington, IN (US)

( * ) Notice: Subject to any disclaimer, the term of this patent is extended or adjusted under 35 U.S.C. 154(b) by 0 days.

(21) Appl. No.: 18/933,085

(22) Filed: Oct. 31, 2024

(65) Prior Publication Data

US 2025/0137750 A1 May 1, 2025

Related U.S. Application Data

(60) Provisional application No. 63/546,600, filed on Oct. 31, 2023.

(51) Int. Cl.
*F41G 1/54* (2006.01)

(52) U.S. Cl.
CPC ..... *F41G 1/545* (2013.01)

(58) Field of Classification Search
CPC ..... F41G 1/545
USPC ..... 42/116, 106, 130
See application file for complete search history.

(56) References Cited

U.S. PATENT DOCUMENTS

| | | | | | |
|---|---|---|---|---|---|
| 4,530,162 | A * | 7/1985 | Forrest | F41G 1/54 | 33/228 |
| 5,060,391 | A * | 10/1991 | Cameron | F41G 3/323 | 42/115 |
| 5,454,168 | A * | 10/1995 | Langner | F41G 3/323 | 42/134 |
| 5,787,631 | A * | 8/1998 | Kendall | F41A 33/02 | 42/116 |
| 6,151,788 | A * | 11/2000 | Cox | G01B 11/27 | 33/286 |
| 10,739,109 | B1 * | 8/2020 | Tello | F41G 3/08 | |

* cited by examiner

*Primary Examiner* — John Cooper
(74) *Attorney, Agent, or Firm* — Naval Surface Warfare Center, Crane Division; Christopher Feigenbutz

(57) ABSTRACT

Provided is a zeroing target for a firearm sighting system that includes a range card insert and a range card sleeve. The range card insert includes zero range increment markings, caliber markings, and a point of aim indicator. The range card sleeve includes a zero range viewing window, a caliber viewing window, a point of aim viewing window, and a point of impact indicator. The range card insert fits within the range card sleeve and can be moved upwards or downwards within the sleeve for selecting a desired zero range increment marking and caliber marking. A laser boresight is aimed at the point of impact indicator and a sighting system on the weapon is adjusted until the sighting system is pointing at the point of aim indicator. When the two values align, the weapon is properly bore-sighted for the desired caliber and range, which can then be confirmed by live fire.

10 Claims, 5 Drawing Sheets

ZEROING TARGET FOR A FIREARM SIGHTING SYSTEM

CROSS-REFERENCE TO RELATED APPLICATIONS

The present application claims priority to U.S. Provisional Patent Application Ser. No. 63/546,600, filed Oct. 31, 2023, entitled "MULTI-RANGE ZEROING TARGET FOR FIREARM SIGHTING SYSTEM," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 210987US02) is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to firearms. More particularly, it pertains to a zeroing target for a firearm sighting system.

BACKGROUND

Zeroing a firearm is the process of adjusting the sighting system to ensure that the point of aim (POA) of the fired round matches the point of impact (POI) at a given distance. Without a proper zero, a fired round may impact too low, too high, or to the left or right of the aiming point. A common method of zeroing is with a laser boresight, which is a laser pointer mounted to the firearm (often within the bore of the barrel) that provides a rough estimate of the POI of the weapon. The sighting system is adjusted until the POA and POI match. Laser boresight systems reduce the amount of live fire needed to properly zero firearms by providing a visible point to begin the zeroing process before any rounds are fired. As can be appreciated, using a weapon that has not been properly zeroed can drastically decrease the accuracy of the weapon and pose a risk posed to the shooter and those downrange.

Military personnel often find themselves in situations where they do not have time or access to a range for zeroing their weapons, such as when riding in a caravan or being stationed on a ship. Additionally, law enforcement, military, hunters, and recreational shooters use an extensive variety of rifle calibers, which causes bore-sighting to become tedious and expensive since a different bore sighting systems and targets are usually required for each caliber/firearm. The current process requires a user to fire their weapon, adjust their sight, and repeat until the sights are zeroed. This is complicated further if multiple weapons are in need of zeroing. It is desirable to make bore-sighting a weapon less labor intensive for the user. Providing a method to zero multiple firearms, regardless of caliber and with a greatly reduced amount of live fire, would address such shortcomings. As can be seen from the above, it is evident that a solution for zeroing multiple firearms, regardless of caliber, is desirable.

SUMMARY OF THE INVENTION

The present invention relates to a zeroing target for a firearm sighting system that includes a range card insert and a range card sleeve. The range card insert includes zero range increment markings, caliber markings, and a point of aim indicator. The range card sleeve includes a zero range viewing window, a caliber viewing window, a point of aim viewing window, and a point of impact indicator. The range card insert fits within the range card sleeve and can be moved upwards or downwards within the sleeve for selecting a desired zero range increment marking and caliber marking. A laser boresight is aimed at the point of impact indicator and a sighting system on the weapon is adjusted until the sighting system is pointing at the point of aim indicator. When the two values align, the weapon is properly bore-sighted for the desired caliber and range, which can then be confirmed by live fire.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
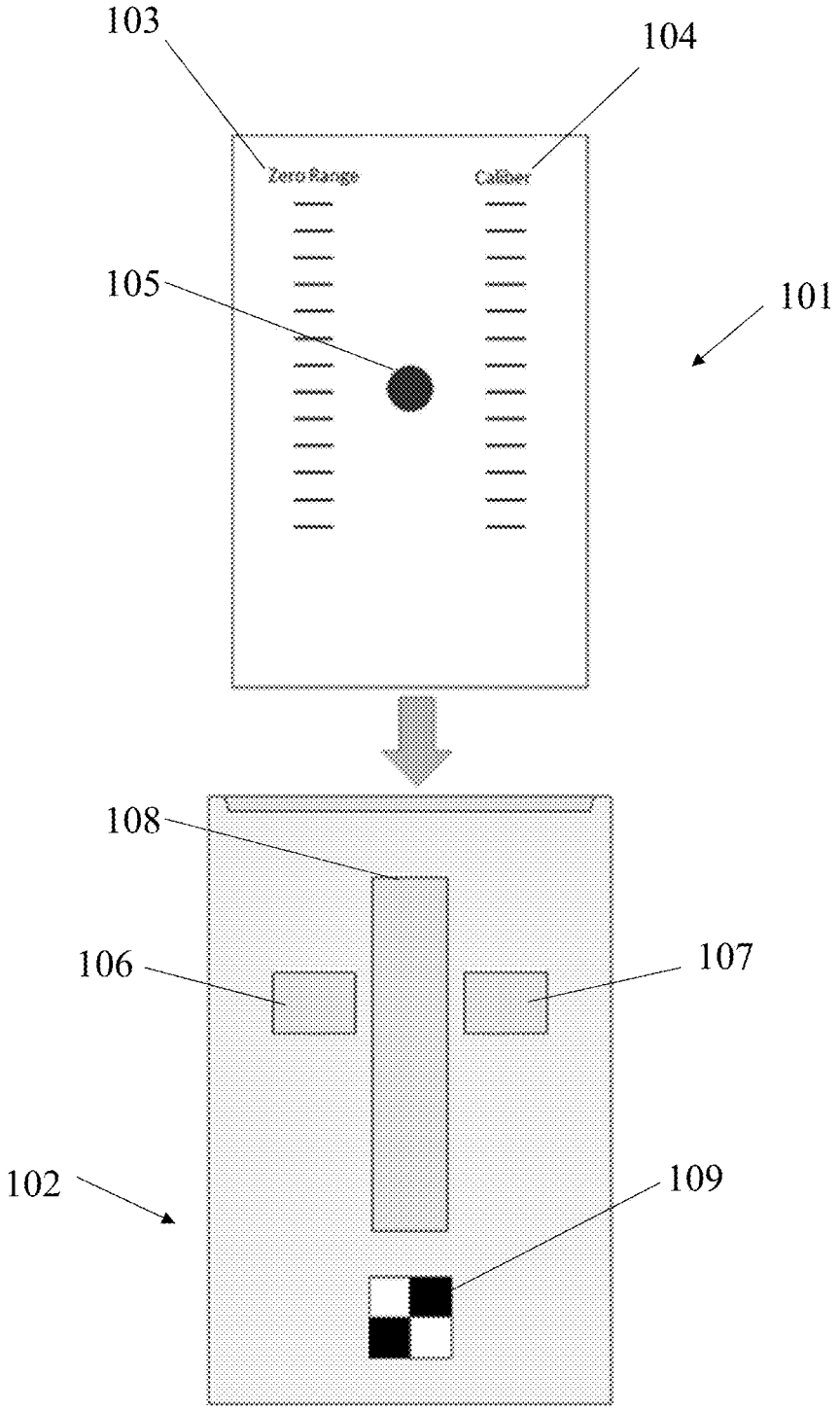
FIG. 1 shows a view of a range card insert and a range card sleeve.

The embodiments of the invention described herein are not intended to be exhaustive or to limit the invention to precise forms disclosed. Rather, the embodiments selected for description have been chosen to enable one skilled in the art to practice the invention.

Generally, provided is a zeroing target for a firearm sighting system comprising; a range card insert comprising one or more zero range increment markings, one or more caliber markings, and a point of aim indicator; and a range card sleeve comprising a zero range viewing window, a caliber viewing window, a point of aim viewing window, and a point of impact indicator. In an illustrative embodiment, the range card insert fits within the range card sleeve. In an illustrative embodiment, a single zero range increment marking is visible through the zero range viewing window, a corresponding single caliber marking is visible through the caliber viewing window, and the point of aim indicator is visible through the point of aim viewing window. In an illustrative embodiment, the range card insert can be adjusted upwards or downwards to view a selected zero range increment marking through the zero range viewing window and a corresponding selected single caliber marking through the caliber viewing window. In an illustrative embodiment, the point of aim indicator moves upwards or downwards in relation to the selected single zero range increment markings and the selected corresponding single caliber markings. In an illustrative embodiment, a weapon have a caliber equivalent to the selected single caliber marking is positioned at a distance equivalent to the selected single zero range increment. In an illustrative embodiment, a laser boresight is aimed at the point of impact indicator and a sighting system on the weapon is adjusted until the sighting system is pointing at the point of aim indicator.

In an illustrative embodiment, one or more zero range increment markings further comprise distances in feet, yards, or meters. In an illustrative embodiment, the caliber markings further comprise one or more projectile weights. In an illustrative embodiment, the range card insert further comprises zeroing ranges for more than one distance. In an illustrative embodiment, the range card insert further comprises zeroing ranges for more than one caliber. In an illustrative embodiment, the range card insert further comprises zeroing ranges for more than one bullet weight.

In an illustrative embodiment, the range card insert comprises a first column comprising zero range increment marking and a second column comprising caliber markings. In an illustrative embodiment, a selected zero range increment marking and its corresponding caliber marking will move the point of aim indicator up or down for zeroing a firearm. In an illustrative embodiment, the zero range increment markings and the corresponding caliber markings can be calculated with respect to a position of the point of aim indicator and printed on the range card insert prior to use. In an illustrative embodiment, the range card insert does not contain the zero range increment markings and the caliber markings.

FIG. 1 shows a view of a range card insert 101 and a range card sleeve 102. In an illustrative embodiment, the range card insert 101 comprises one or more zero range increment markings 103, one or more caliber markings 104, and a point of aim indicator 105. In an illustrative embodiment, the range card sleeve 102 comprises a zero range viewing window 106, a caliber viewing window 107, a point of aim viewing window 108, and a point of impact indicator 109. The range card insert 101 fits within the range card sleeve 102. In an illustrative embodiment, the range card insert 101 and range card sleeve 102 are designed such that a zero range increment marking 103 is visible through the zero range viewing window 106, a corresponding caliber marking 104 is visible through the caliber viewing window 107, and the point of aim indicator 105 is visible through the point of aim viewing window 108. The point of aim viewing window 108 is an elongated window that permits viewing of the point of aim indicator 105 regardless of its position within the range card sleeve 102. The point of impact indicator 109 is a fixed indicator positioned on the range card sleeve 102. The point of aim indicator 105 is positioned on the range card insert 107 in a location that allows zeroing of a firearm sighting system relative to the selected zero range increment markings 101 and caliber markings 102. As can be appreciated, the point of aim indicator 105 moves up or down with respect to the point of impact indicator 109, which is located at a fixed position on the range card sleeve 101.

Figure 2:
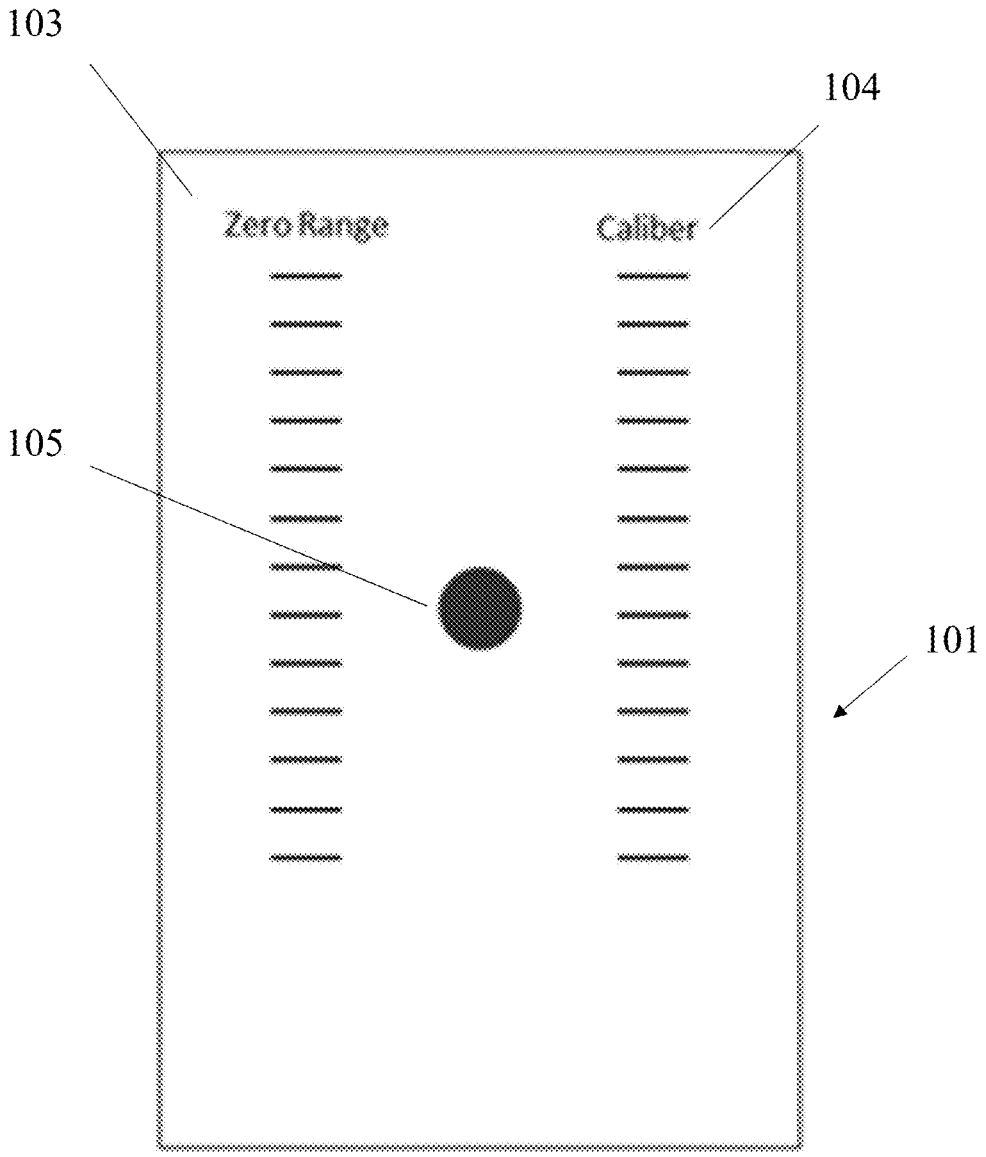
FIG. 2 shows a view of a range card insert.
Figure 3:
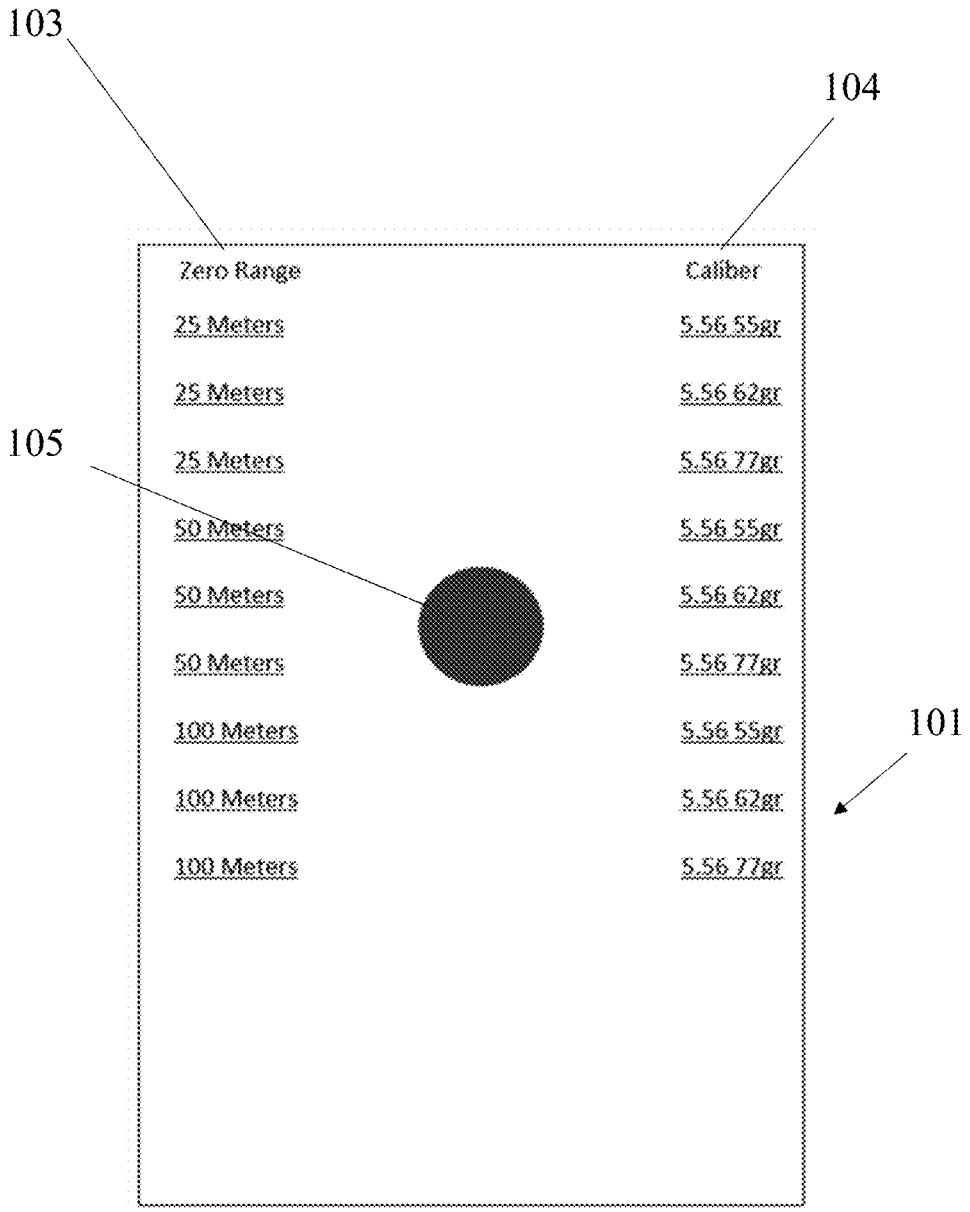
FIG. 3 shows a view of a range card insert illustrating exemplary range and caliber markings.

FIG. 2 shows a view of a blank range card insert 101, and FIG. 3 shows a view of a range card insert 101 illustrating exemplary range and caliber markings. In an illustrative embodiment, the range card insert 101 comprises a first column comprising zero range increment marking 103 and a second column comprising caliber markings 104. In an illustrative embodiment, a selected zero range increment marking 103 and its corresponding caliber marking 104 will move the point of aim indicator 105 up or down for zeroing a firearm, which will be discussed in greater detail below. In an illustrative embodiment, the zero range increment markings 103 and the corresponding caliber markings 104 can be calculated with respect to the position of the point of aim indicator 105 and printed on the range card insert 102 prior to use. In an alternate embodiment, the range card insert 101 can be blank to allow a user to fill in the desired zero range increment markings 103 and caliber markings 104. In such an embodiment, the point of aim indicator 105 can be filled in at a desired location to correspond to the desired zero range increment markings 103 and caliber markings 104.

In a non-limiting example, the zero range increment markings 103 can include distances in feet, yards, or meters, and can be a distance such as 25 yards, 75 feet, 50 meters, and the like. In a non-limiting example, the caliber markings 104 can be for use with any known small arms caliber, such as .22LR, 5.56×45 NATO, 7.62×51 NATO, 6.5 Creedmoor, and the like. In a non-limiting example, the caliber markings 104 can also account for differences in projectile weights, such as 77 grain, 62 grain, 55 grain 5.56×45 NATO, and the like. In a non-limiting example, the zero range increment marking 103 can be labeled 50 meters and the caliber markings 104 can be labeled for a 55 grain 5.56×45 NATO round.

Figure 4:
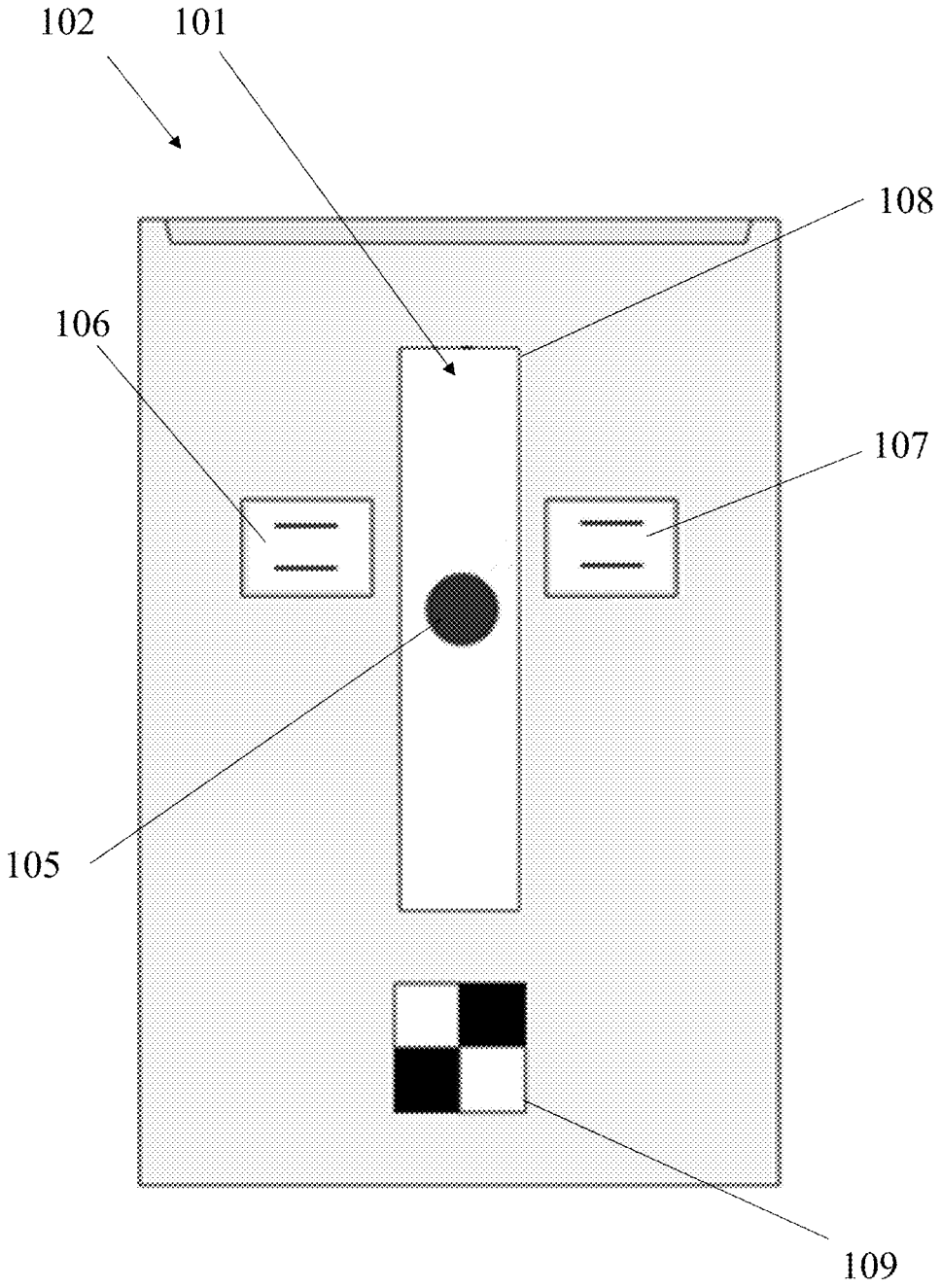
FIG. 4 shows a view of a range card insert within a range card sleeve.

FIG. 4 shows a view of a range card insert 101 within a range card sleeve 102. In an illustrative embodiment, the range card insert 101 fits within the range card sleeve 102 and can be adjusted upwards or downwards based on the desired caliber and zeroing distance. When adjusted upwards or downwards, a selected zero range increment marking 103 is visible through the zero range viewing window 106 and a corresponding single caliber marking 104 is visible through the caliber viewing window 107. In an illustrative embodiment, the point of aim indicator 105 moves upwards or downwards in relation to the selected single zero range increment markings 103 and the corresponding single caliber markings 104.

In an illustrative embodiment, a weapon have a caliber equivalent to the selected single caliber marking 104 is positioned at a distance equivalent to the selected single zero range increment 103. A laser boresight is aimed at the point of impact indicator 109 and a sighting system on the weapon is adjusted until the sighting system is pointing at the point of aim indicator 105.

Figure 5:
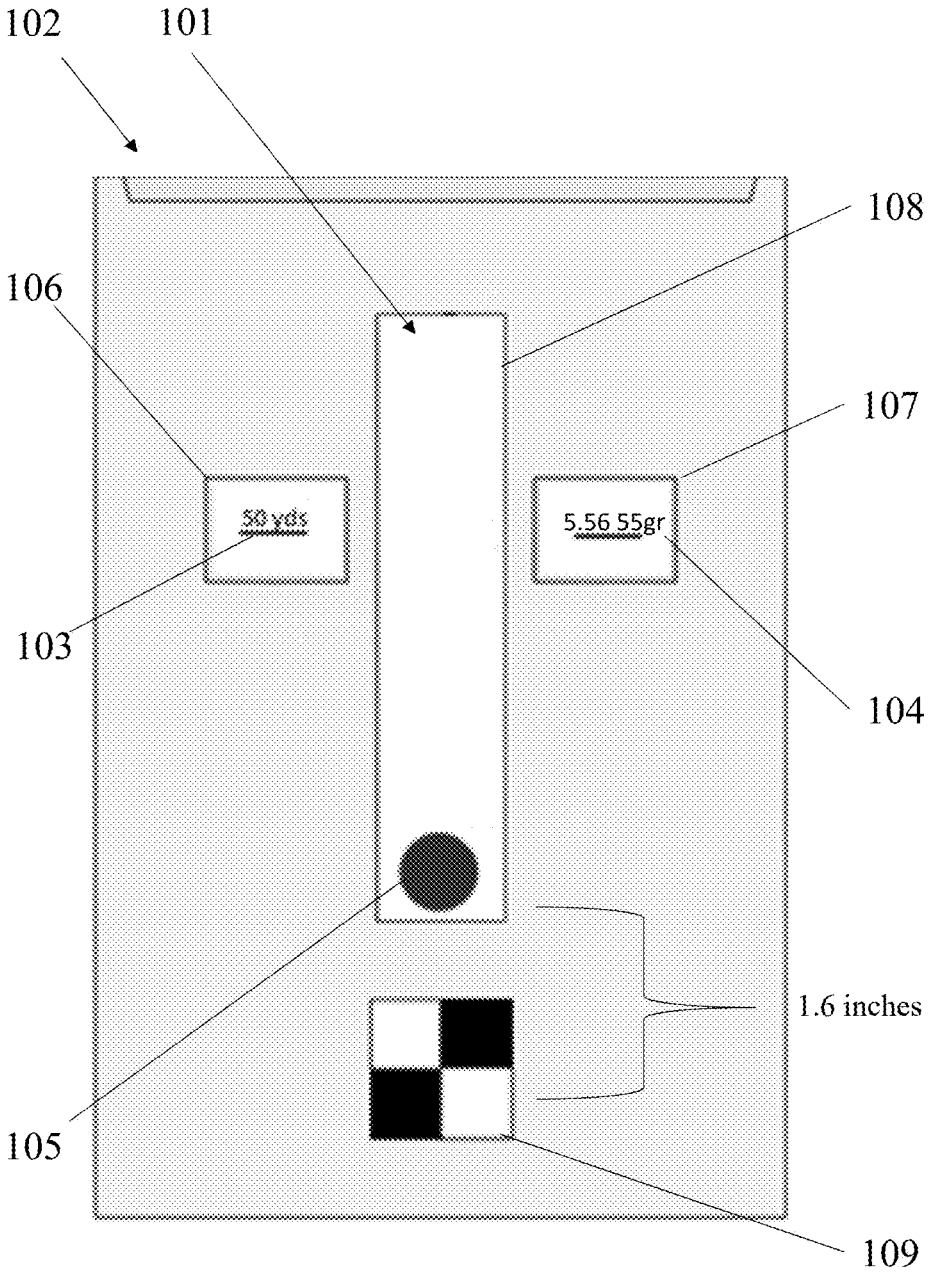
FIG. 5 shows a view of a range card insert within a range card sleeve illustrating exemplary range and caliber markings.

FIG. 5 shows a view of a range card insert 101 within a range card sleeve 102 illustrating exemplary range and caliber marking. In a non-limiting illustrative example, when the 50 meter zero range increment marking 103 is visible through the zero range viewing window 106 and the corresponding 55 grain 5.56×45 NATO caliber marking 104 is visible through the caliber viewing window 107, the point of aim indicator 105 moves to a distance of 1.6 inches above the point of impact indicator 109. As can be appreciated, it is known that gravity causes a 55 grain 5.56×45 NATO round traveling at a velocity of 3250 feet per second to drop 1.6 inches in 50 meters, which is verifiably by conventional ballistic charts. When these values are visible through the zero range viewing window 106, and caliber viewing window 107, a laser point from a boresight positioned in the barrel of a weapon is aimed at the point of impact indicator 109, and the sighting system on the weapon is adjusted until it is pointing at the point of aim indicator 105. Once the sighting system is aligned with the point of impact indicator

109 and the boresight laser is aligned with the point of impact indicator 109, the weapon is bore-sighted for the desired caliber and range. Live fire can then be performed to verify and adjust POA/POI as required.

The inventive multi-range bore-sighting target described herein provides users with a boresight that can function for potentially any desired caliber. The device operates as a single target that can accommodate multiple zeroing ranges for various distances, calibers, and bullet weights.

Although the invention has been described in detail with reference to certain preferred embodiments, variations and modifications exist within the spirit and scope of the invention as described and defined in the following claims.

The invention claimed is:

1. A zeroing target for a firearm sighting system comprising;

a range card insert comprising one or more zero range increment markings, one or more caliber markings, and a point of aim indicator; and a range card sleeve comprising a zero range viewing window, a caliber viewing window, a point of aim viewing window, and a point of impact indicator;

wherein said range card insert fits within said range card sleeve;

wherein a single zero range increment marking is visible through said zero range viewing window, a corresponding single caliber marking is visible through said caliber viewing window, and said point of aim indicator is visible through said point of aim viewing window;

wherein said range card insert can be adjusted upwards or downwards to view a selected zero range increment marking through said zero range viewing window and a corresponding selected single caliber marking through said caliber viewing window;

wherein said point of aim indicator moves upwards or downwards in relation to said selected single zero range increment markings and said selected corresponding single caliber markings;

wherein a firearm have a caliber equivalent to said selected single caliber marking is positioned at a distance equivalent to said selected single zero range increment, and wherein a laser boresight is aimed at said point of impact indicator and a sighting system on said firearm is adjusted until said sighting system is pointing at said point of aim indicator.

2. The system of claim 1, wherein said one or more zero range increment markings further comprise distances in feet, yards, or meters.

3. The system of claim 1, wherein said caliber markings further comprise one or more projectile weights.

4. The system of claim 1, wherein said range card insert further comprises zeroing ranges for more than one distance.

5. The system of claim 1, wherein said range card insert further comprises zeroing ranges for more than one caliber.

6. The system of claim 1, wherein said range card insert further comprises zeroing ranges for more than one bullet weight.

7. The system of claim 1, wherein said range card insert comprises a first column comprising zero range increment marking and a second column comprising caliber markings.

8. The system of claim 1, wherein a selected zero range increment marking and its corresponding caliber marking will move said point of aim indicator up or down for zeroing a firearm.

9. The system of claim 1, wherein said zero range increment markings and said corresponding caliber markings can be calculated with respect to a position of said point of aim indicator and printed on said range card insert prior to use.

10. The system of claim 1, wherein said range card insert does not contain said zero range increment markings and said caliber markings.

* * * * *